US005333429A

United States Patent [19]

Cretti

[11] Patent Number: 5,333,429

[45] Date of Patent: Aug. 2, 1994

[54] MODULAR PANEL OF EXPANDED SYNTHETIC MATERIAL PROVIDED WITH STAGGERED LONGITUDINAL "T"-SHAPED CHANNELS, RECEIVING "T"-SHAPED WOODEN POSTS USEFUL FOR ERECTING WALLS

[75] Inventor: Piero Cretti, Morbio Superiors, Switzerland

[73] Assignee: Plastedil, S.A., Chiasso, Switzerland

[21] Appl. No.: 982,734

[22] PCT Filed: Jul. 8, 1991

[86] PCT No.: PCT/EP91/01270

§ 371 Date: Feb. 19, 1993

§ 102(e) Date: Feb. 19, 1993

[87] PCT Pub. No.: WO93/01371

PCT Pub. Date: Jan. 21, 1993

[51] Int. Cl.[5] ..... E04C 1/00

[52] U.S. Cl. ..... 52/309.7; 52/309.4

[58] Field of Search ..... 52/309.2, 309.7, 309.8, 52/309.9, 309.11, 699, 701

[56] References Cited

U.S. PATENT DOCUMENTS

| | | | |
|---|---|---|---|
| 2,108,107 | 2/1938 | DeWees | 52/701 |
| 3,353,315 | 11/1967 | Barker | 52/309.11 X |
| 3,782,049 | 1/1974 | Sachs | 52/309.7 X |
| 4,163,349 | 8/1979 | Smith | 52/309.2 X |
| 4,443,988 | 4/1984 | Coutu, Sr. | 52/309.2 X |
| 4,471,591 | 9/1984 | Jamison | 52/309.9 |
| 4,478,021 | 10/1984 | Person | 52/309.7 X |
| 5,003,742 | 4/1991 | Dettbarn | 52/309.8 X |
| 5,067,296 | 11/1991 | Brown et al. | 52/309.7 |
| 5,079,885 | 1/1992 | Dettbarn | 52/309.8 X |

FOREIGN PATENT DOCUMENTS

| | | | |
|---|---|---|---|
| 1116371 | 1/1982 | Canada . | |
| 2348396 | 8/1975 | Fed. Rep. of Germany . | |
| 1148454 | 12/1957 | France . | |
| 2566028 | 12/1985 | France | 52/309.2 |
| 2597135 | 10/1987 | France . | |
| 83/00054 | 1/1983 | PCT Int'l Appl. . | |

*Primary Examiner*—Carl D. Friedman
*Assistant Examiner*—Kevin D. Wilkens
*Attorney, Agent, or Firm*—Pollock, Vande Sande & Priddy

[57] ABSTRACT

A composite panel (1) particularly suited for erecting buildings with a structural load-bearing wooden framework (4) is formed by a substantially parallelepiped body of expanded synthetic material having a standardized thickness, a modularly standardized width and a customized height, which is congruent with the design floor height of the building to be constructed. The panels have a plurality of longitudinal channels extending for the whole height of the panel. A series of channels (2,3) uniformly spaced and staggered in the sense of said width and of said thickness of the panel, are open on the adjacent face of the panel and have a T-shaped cross section. In these open channels fit T-shaped cross section wooden posts (4), the stem portion (**4*b***) of which emerges out of said open channels and project from the surface of the panel. The series of staggered T wooden posts confer load-bearing capabilities to the composite panel while providing vertically oriented "ribs" emerging from the face of the expanded synthetic material panel onto which an outer finishing of the wall may be easily anchored.

3 Claims, 3 Drawing Sheets

MODULAR PANEL OF EXPANDED SYNTHETIC MATERIAL PROVIDED WITH STAGGERED LONGITUDINAL "T"-SHAPED CHANNELS, RECEIVING "T"-SHAPED WOODEN POSTS USEFUL FOR ERECTING WALLS

DESCRIPTION TECHNICAL FIELD

The present invention relates to the techniques for erecting load-bearing walls and dividing walls of a building by means of modularly assemblable panels of an expanded synthetic material, destined to receive a lining and wherein the load structure comprises a framework of wooden posts and beams.

BACKGROUND OF THE INVENTION

The use of modularly assembleable elements off expanded synthetic material, typically of expanded polystyrene or polyurethane, for forming perimetral walls and internal dividing walls, traversed or not by steel-reinforced concrete pillars, which are formed in cavities which are purposely formed into the expanded polystyrene bodies, as well as of floor slabs, roofs, etc., has long now become a widespread practice in the building industry because of the numerous advantages that these building techniques offer in respect to more traditional techniques, under innumerable conditions. both in the residential and commercial building industry.

While the use of modular panels of expanded synthetic material for erecting perimeteral walls and dividing walls has enjoyed a ready acceptance in the building industry where the load structure is commonly made by a framework of steel-reinforced concrete, the technique hasn't had a similar acceptance where the most common building technique is that of erecting a Building structure in the form-of a wooden framework. This difference of acceptance may be ascribed to the fact that while in the case of reinforced-steel load-bearing structures the modular panels provided with internal channels advantageously provide in a very simple and effective manner the "molds" in which the steel reinforcing means may be set and the concrete poured. This fundamental advantage is no longer so significant in the case of buildings with a wooden framework, wherein the wooden structural members normally provide ideal fastening "ribs" for external and internal wood panelling, tile facing, or plaster or mortar coat. In this type of wooden framework buildings, the thermal insulation is commonly made by "filling" the space between the two wall linings, internal and external, with loose isolating material or with panels or mats of insulating material, such as for example expanded polystyrene or polyurethane panels or glass or rock fiber mats supported on paper, and alike materials, which may be suitably shaped or cut to measure during the laying. In other words, the erection of the structure may be made according to traditional techniques, before laying the insulating material, which may be done usually after having completed one of the two external or internal paneling.

SUMMARY OF THE INVENTION

It has now been found that the use of modular panels of an expanded synthetic material having peculiar characteristics may have outstanding advantages also for erecting wooden framework buildings.

It is therefore a main objective of the present invention to provide a modular panel of an expanded synthetic material particularly suited for erecting perimetral walls and internal dividing walls, wherein the load is substantially borne by wooden risers or posts which are part of a load-bearing framework structure of the building. The panels of the invention are substantially composite, load-bearing panels, which beside permitting the fastening of the facing or finishing material of the wall to the wooden posts, which are part of the composite panel for conferring to the panel load-bearing properties and which upon mechanical connection constitute the wooden load-bearing framework of the building, permit also a great simplification of the erection of the load-bearing wooden framework structure itself.

Basically the panel of the invention comprises a parallelepiped self-supporting body of an expanded synthetic material, having a standardized thickness, a width modularly standardized and a height which may be predetermined during production of the panels, In order to coincide, or be congruent, with the height between two floors of the building to be constructed, and which is provided with a series of longitudinal channels, uniformly spaced and staggered, on both major surfaces of the panel, and having a T-shaped cross section, into which T-shaped cross section wooden posts are inserted, the stem portion of which projects out of the surface of the panel.

Each composite panel thus formed, constitutes a true modular element of a wall, which is intrinsically provided with a sufficient load-bearing capability which is conferred to the composite panel by the T-shaped wooden risers which are inserted in the T-shaped channels of the body of expanded synthetic material.

The disposition, alternately staggered, on one side and on the other side of the panel, of the wooden posts in the sense of the length of the wall being erected, provides a great rigidity to the structure and each wooden post has a cross section which presents a stem portion or lateral projection which juts out of the surface of the panel and therefore is perfectly available for fastening a wall outer finishing thereto. The panels of expanded synthetic material by receiving the wooden posts into respective T-shaped vertical channels by insertion, sustain the wooden posts themselves in a perfectly vertical position until they are connected at the base and at the top, thus greatly facilitating the erection work of the same load-bearing structure of the building beside ensuring a perfect continuity of the insulating layer and thus a great efficiency in terms of thermal insulation of the building.

BRIEF DESCRIPTION OF DRAWINGS

The different aspects and advantages of the composite panels of the present invention will become evident through the following detailed description of preferred embodiments and by reference to the attached drawings, wherein.

BEST AND VARIOUS MODES FOR CARRYING OUT INVENTION

Figure 1:
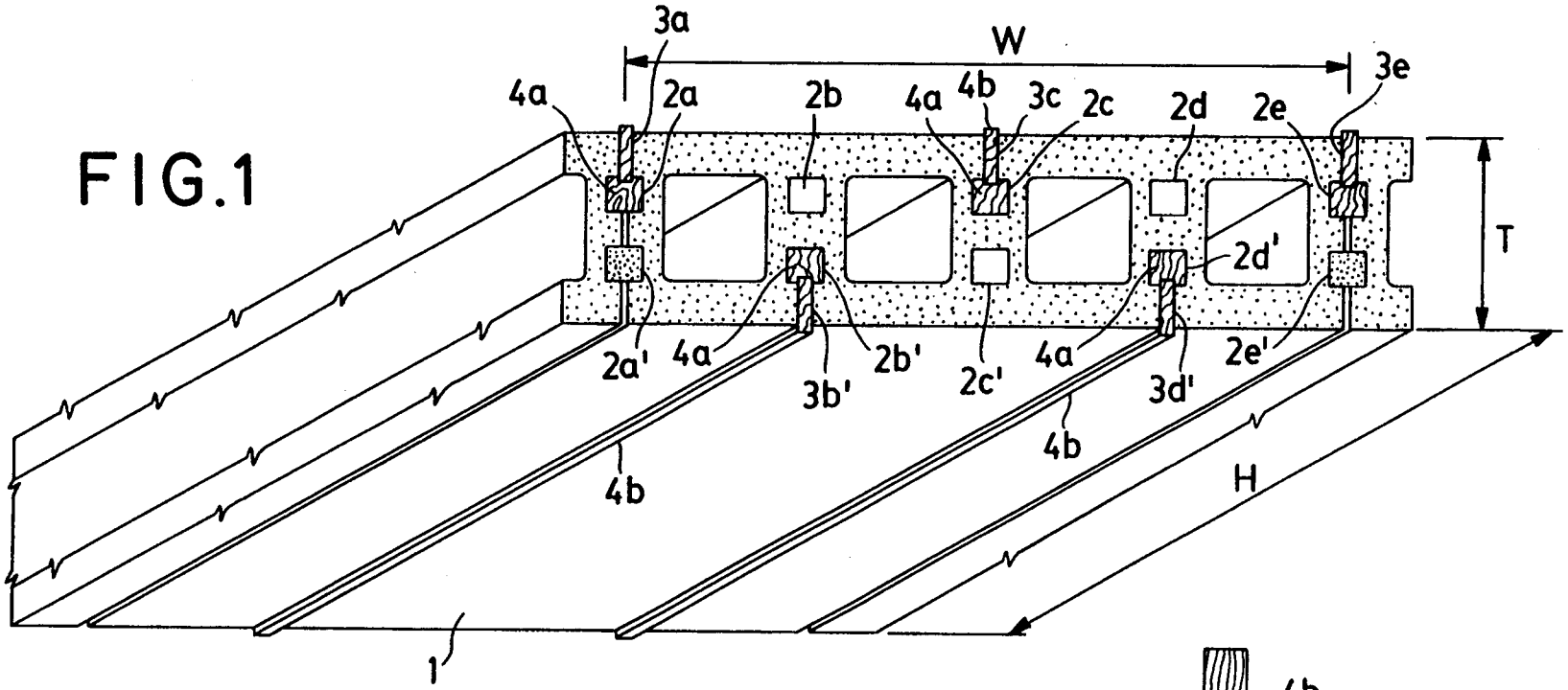
FIG. 1 is a partial, schematic, perspective cross sectional view of a wall made with the panels of the present invention.

With reference to FIG. 1, a load-bearing perimetral wall is erected by laying modularly assemblable panels one next to the other. In the partial view of FIG. 1, a panel 1 is shown to have a standardized width W, a standardized thickness T, and a height H which is preferably predetermined when fabricating the panels by expanding a synthetic material, such as for example a polystyrene, a polyurethane, etc., in a mold. The height dimension of the panels, which may be easily customized during the production of the composite panels, is predetermined in base to the particular requirements of the customer in order to advantageously correspond or be congruent with the height between floors of the building to be erected. Each panel is provided with a plurality of channels or series of longitudinal channels, which extend for the whole predefined height H of the panel. The number, the dimensions, and the shape of these longitudinal channels may be different, however, in accordance with a preferred embodiment of the present invention, the panel is provided with at least a series of pairs of opposite channels: *2a–2a'*, *2b–2b'*, *2c–2c'*, *2d–2d'*, *2e–2e'*, which have a substantially rectangular cross section, for instance a square cross section, and alternately the channels are open longitudinally toward the adjacent major surface of the panel by a longitudinal "cut": *3a*, *3c*, *3e*, on one face of the panel and *3b'* and *3d'*, on the opposite face of the panel, i.e. these staggered channels have a cross section shaped as an inverted T.

Inside these inverted T, longitudinal channels (open toward the adjacent face of the panel) are inserted special wooden risers *4a*, which have a T-shaped cross section, so that the "stem" portion *4b* of the T-cross section of the wooden posts passes through the longitudinal cut of the inverted T-shaped channels and projects out of the major surface of the panel.

Figure 2:
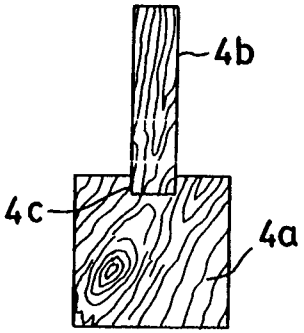
FIG. 2 is a cross sectional view of a wooden post, having a T-shaped cross section, which is employed in the composite panels of the invention.

A T-shaped cross section of the special wooden risers used in the composite panels of the invention is shown in FIG. 2. Each wooden riser may be formed by a square log *4a* and by a stem portion *4b*, which may be made by joining a wooden board to the square log. The joint may be made preferably by dovetailing (*4c*).

The outer end of the stem portion *4b* of the T wooden posts, by projecting as shown from the face of the expanded synthetic material panel, constitutes an 1deal load-bearing and fastening vertical "rib" for an outer finishing panelling of the wall.

Figure 3:
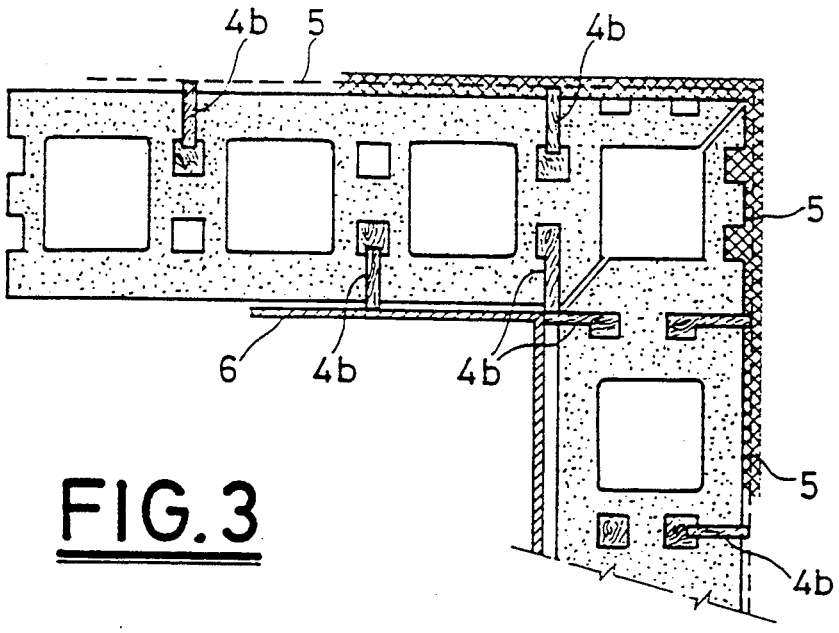
FIG. 3 is a partial, schematic, cross sectional, plan view of a perimetral wall made with the panels of the invention.

An exemplary application of the composite panels of the present invention is schematically shown in FIG. 3. As it may be easily observed in this figure, the modularity of the panels 1 permits an easy realization of corners and T-joints, by simply cutting the modular panels according to needs. In the example shown, a perimetral wall may, once erected, be finished externally with a mortar coat for exterior which may be anchored to the wooden posts of the composite panels by means of a metallic screen, i.e. an expanded metal screen 5, which may be easily fastened onto the "ribs" represented by the projecting ends *4b* of the T-shaped wooden posts. The external facing may also include a masonry wall or a tile facing, or other suitable exterior facing materials.

Similarly, the internal face of the wall may be paneled with plaster board sheets 6, which may be directly fastened on the projecting ends *4b* of the T-shaped wooden posts, which project from the face of the composite panels. Of course also on the interior face of the wall an expanded metal screen may be fixed on the projecting portions of the wooden posts of the composite panels forming the wall for applying a finishing plaster coat or for laying tiles, e.g. in kitchen and bathroom areas and alike.

Figure 4:
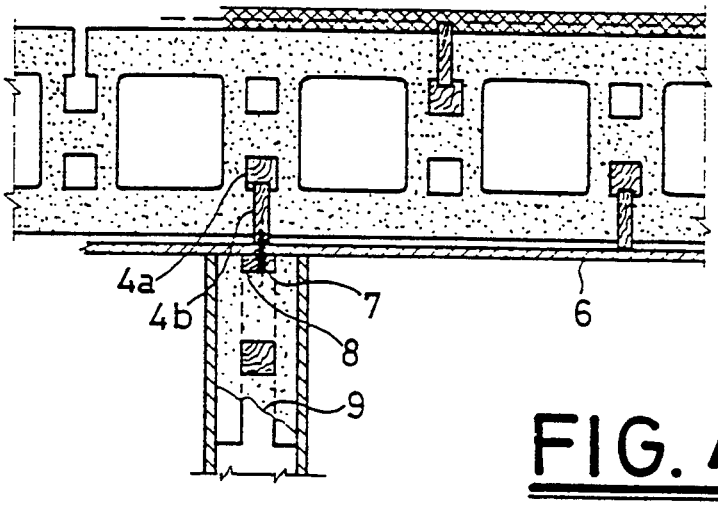
FIG. 4 is a partial, schematic, cross sectional, plan view showing the connection to a perimetral wall of an infernal dividing wall.

A manner of connecting an internal dividing wall to a perimetral wall is shown in FIG. 4. As visible in the partial cross section of FIG. 4, the Joining may be accomplished through the internal lining 6 (e.g. plaster board) of the wall, by nailing or fastening 6 by means of screws a wooden "semilog" on the rib *4b* of a T-shaped wooden pose of the perimetral wall projecting from the internal face of the panel. A modular composite panel for internal wall 9 may then mate, through a terminal "semichannel" 8, with the "semilog" 7, so fastened on the internal face of the perimetral wall. The modular panels for internal dividing walls may have a composite structure different from the panels of the invention, as in the example shown in FIG. 4, or may also have a composite structure similar to the structure of the panels the invention.

According to a preferred embodiment of the invention, the panels having modularly predefined dimensions are fabricated in their composite form at the production site, i.e., the wooden T-shaped cross section posts are inserted in the respective, reversed T, staggered channels, at the conclusion of the mold-forming of the channeled panels of expanded synthetic material. Alternatively, the wooden risers may be coupled to the channeled panels of expanded synthetic material at the erection site, before proceeding to set the panels in place.

Figure 5:
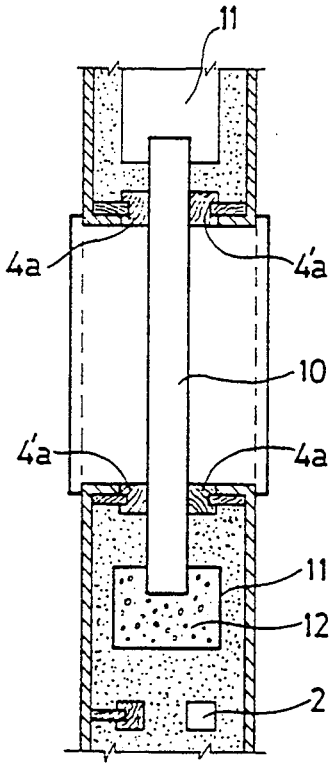
FIG. 5 is a partial, schematic, cross sectional view showing the way of forming a window's sill support.

A manner of forming a window or a door in the structure is shown in FIG. 5. An adequate size opening in the panel is produced preferably between a pair of T-shaped channels, having T-cross section wooden posts inserted therein. The risers of the frame of the window or of the door may then be formed substantially by the same T-cross section wooden posts. Usefully, when arranging for window or door frames, additional T-cross section wooden risers *4a'* may be installed in the channels (normally empty) directly opposing the staggered posts *4a* which are already present in the composite panel. To this purpose, the longitudinal channels 2, opposed to the inverted T-cross section channels accommodating the wooden posts may be used by making the necessary cuts through the expanded synthetic material body of the panel, as may be necessary. A sturdy wooden beam 10 may be conveniently introduced between the opposing wooden risers of the frame of the door or of the window and be suitably supported at a certain height in order to constitute a door's or window's sill support. As shown in the example of FIG. 5, in the case of a window, the reinforcing beam 10 may be set and blocked in position and sustained at the set height from the floor for example by pouring concrete inside the longitudinal channels 11 of the panels. These longitudinal channels of relatively large cross section of the panels may also be usefully exploited as concrete molds in mixed-type, load bearing, structures, which comprise pillars and eventually also beams made with reinforced concrete. These reinforcing pillars and beams may be formed by disposing inside the relative channel of the panels the reinforcing steel latticework, connecting it no a foundation reinforcing latticework and then pouring the concrete inside the channels to form the reinforced concrete pillars.

Figure 6:
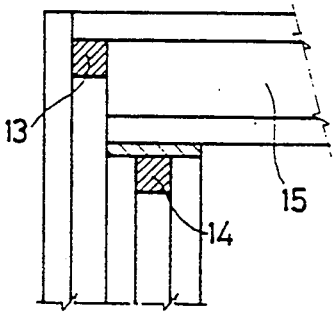
FIG. 6 is a partial, schematic, cross section, elevation view showing a way of forming a floor slab resting on a load-bearing perimetral wall.

The joining of a floor slam to a load-bearing wall made with the composite panels of the invention, is schematically shown in FIG. 6. Over the two staggered orders off wooden poses of the composite panels, perimetral wooden beams are disposed, preferably at different levels, as shown. On these perimetral horizontal beams 14 bear the floor beams which have an H-shaped cross section. The end of each floor beam is cut in a staggered way so as to bear on both horizontal perimetral beams 13 and 14, which are purposely set at two different levels.

Figure 7:
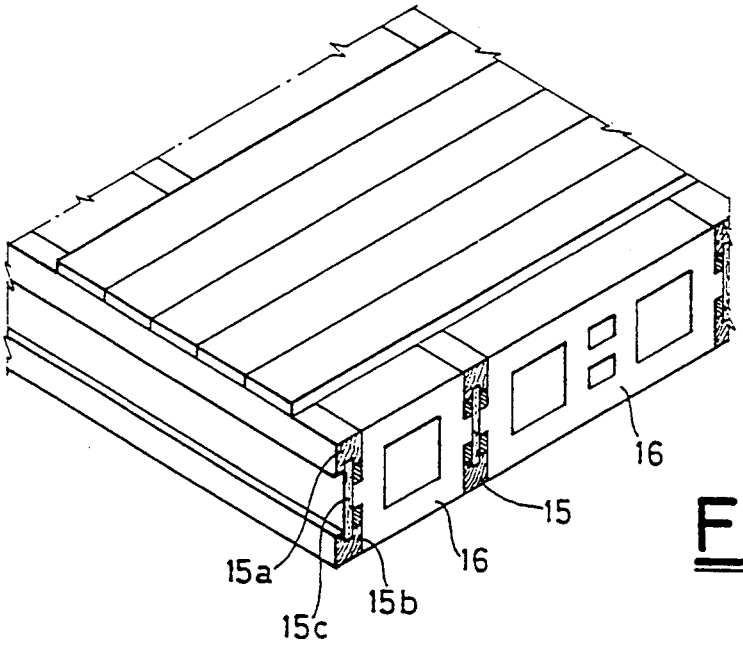
FIG. 7 is a partial, schematic, perspective view showing the structure of a floor slab particularly suited for a building made with the composite panels of the invention.

The shape of each floor beam 15 and the whole-structure of the floor is depicted in FIG. 7.

Each beam is shaped as an H and is formed by two channeled wooden logs 15*a* and 15*b*, joined by means of a board 15*c*, which is vertically set into the two longitudinal channels of the top log and of the bottom log of the beam. Between parallel floor beams, modular panels of expanded synthetic material 16 are set to provide a sufficient acoustic and thermal insulation through the floor slab and on the floor beams is laid the floor, which may be made of polished wood boards or rough boards to be covered by linoleum, wall to wall carpeting or with a reinforcing metal screen for anchoring a mortar layer onto which ceramic tiles or the like may be cemented.

I claim:

1. A panel for constructing walls comprising a substantially parallelepiped body of an expanded synthetic material, having a standardized thickness, a modularly standardized width and a customized height and having a plurality of channels which extend longitudinally for the entire height of the panel, disposed at regular intervals along said modularly standardized width of the panel, characterized by the fact that the panel is provided with a plurality of channels, regularly spaced and staggered along said width and thickness of the panel and having a T-shaped cross section, open on the adjacent major surface of the panel; said T-shaped open channels receiving therein a wooden post having a mating T-shaped cross section, the stem portion of which projects out of the panel's surface.

2. A panel as defined in claim 1, wherein said T-cross section channels belong to a series of pairs of parallel channels opposing each other along the thickness of the panel; one channel of each pair being alternately open longitudinally toward the adjacent face of the panel through a longitudinal cut through which said stem portion of said T-shaped cross section poses passes.

3. A load-bearing composite panel for building walls comprising a substantially parallelepiped body of expanded synthetic material having a standardized thickness and a modularly standardized width and a customized height and having a plurality of channels which extend longitudinally for the entire height of the panel arranged at modularly regular intervals along said standardized width of the panel, wherein a series of said channels are uniformly spaced and staggered in the sense of the thickness and of the width of said panel and are open by means of a longitudinal cut toward the adjacent face of the panel; wooden poses having a T-shaped cross section are set into said longitudinally open channels, the stem portion of said cross section of the wooden posts passing through said longitudinal cut of the receiving channel and projecting from the face of the panel;

said staggered T-cross section wooden posts being capable of conferring load-bearing properties to the composite panel.

* * * * *